US007912407B2

(12) United States Patent
Okamoto et al.

(10) Patent No.: US 7,912,407 B2
(45) Date of Patent: Mar. 22, 2011

(54) DEVELOPING UNIT, DEVELOPING DEVICE AND IMAGE FORMING APPARATUS FOR PEELING OFF MAGNETIC DEVELOPER

(75) Inventors: Tetsuji Okamoto, Ebina (JP); Koichi Watanabe, Ebina (JP); Atsuyuki Kitamura, Ebina (JP); Masahiro Sato, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 268 days.

(21) Appl. No.: 12/222,637

(22) Filed: Aug. 13, 2008

(65) Prior Publication Data

US 2009/0169269 A1 Jul. 2, 2009

(30) Foreign Application Priority Data

Dec. 28, 2007 (JP) ..... 2007-341418

(51) Int. Cl.
*G03G 15/09* (2006.01)

(52) U.S. Cl. ..... 399/227; 399/119; 399/222; 399/273

(58) Field of Classification Search ..... 399/273, 399/227, 119, 222
See application file for complete search history.

(56) References Cited

U.S. PATENT DOCUMENTS

| | | | | |
|---|---|---|---|---|
| 5,227,848 | A * | 7/1993 | Robinson et al. | 399/53 |
| 5,523,533 | A | 6/1996 | Itoh et al. | 118/658 |
| 2002/0025202 | A1 * | 2/2002 | Itaya et al. | 399/350 |

FOREIGN PATENT DOCUMENTS

| | | | |
|---|---|---|---|
| JP | 54-124734 | | 9/1979 |
| JP | 58223165 | A * | 12/1983 |
| JP | 61-20961 | | 1/1986 |
| JP | 07-152251 | | 6/1995 |
| JP | 10123824 | A * | 5/1998 |
| JP | 2001-22182 | | 1/2001 |
| JP | 2002072805 | A * | 3/2002 |
| JP | 2003-167435 | | 6/2003 |
| JP | 2004-219819 | | 8/2004 |

* cited by examiner

*Primary Examiner* — David M Gray
*Assistant Examiner* — G. M. Hyder
(74) *Attorney, Agent, or Firm* — Morgan, Lewis & Bockius LLP

(57) ABSTRACT

A developing unit includes: a developer carrying member that visualizes an electrostatic latent image held on an image carrying member using magnetic developer; a peeling member that peels off the magnetic developer held on the developer carrying member by a magnetic force; and a movement controller that controls movement of the peeling member, when the peeling member peels off the magnetic developer, the movement controller moving the peeling member to a position close to the developer carrying member, and when the peeling member has peeled off the magnetic developer, the movement controller moving the peeling member to a position away from the developer carrying member.

20 Claims, 13 Drawing Sheets

DEVELOPING UNIT, DEVELOPING DEVICE AND IMAGE FORMING APPARATUS FOR PEELING OFF MAGNETIC DEVELOPER

CROSS-REFERENCE TO RELATED APPLICATIONS

This application is based on and claims priority under 35 USC 119 from Japanese Patent Application No. 2007-341418 filed Dec. 28, 2007.

BACKGROUND

Technical Field

The present invention relates to a developing unit, a developing device and an image forming apparatus.

SUMMARY

According to an aspect of the present invention, there is provided a developing unit including: a developer carrying member that visualizes an electrostatic latent image held on an image carrying member using magnetic developer; a peeling member that peels off the magnetic developer held on the developer carrying member by a magnetic force; and a movement controller that controls movement of the peeling member, when the peeling member peels off the magnetic developer, the movement controller moving the peeling member to a position close to the developer carrying member, and when the peeling member has peeled off the magnetic developer, the movement controller moving the peeling member to a position away from the developer carrying member.

BRIEF DESCRIPTION OF THE DRAWINGS

Exemplary embodiments of the present invention will be described in detail based on the following figures, wherein.

DETAILED DESCRIPTION

Next, a first exemplary embodiment of the present invention will be described based on the drawings.

Figure 1:
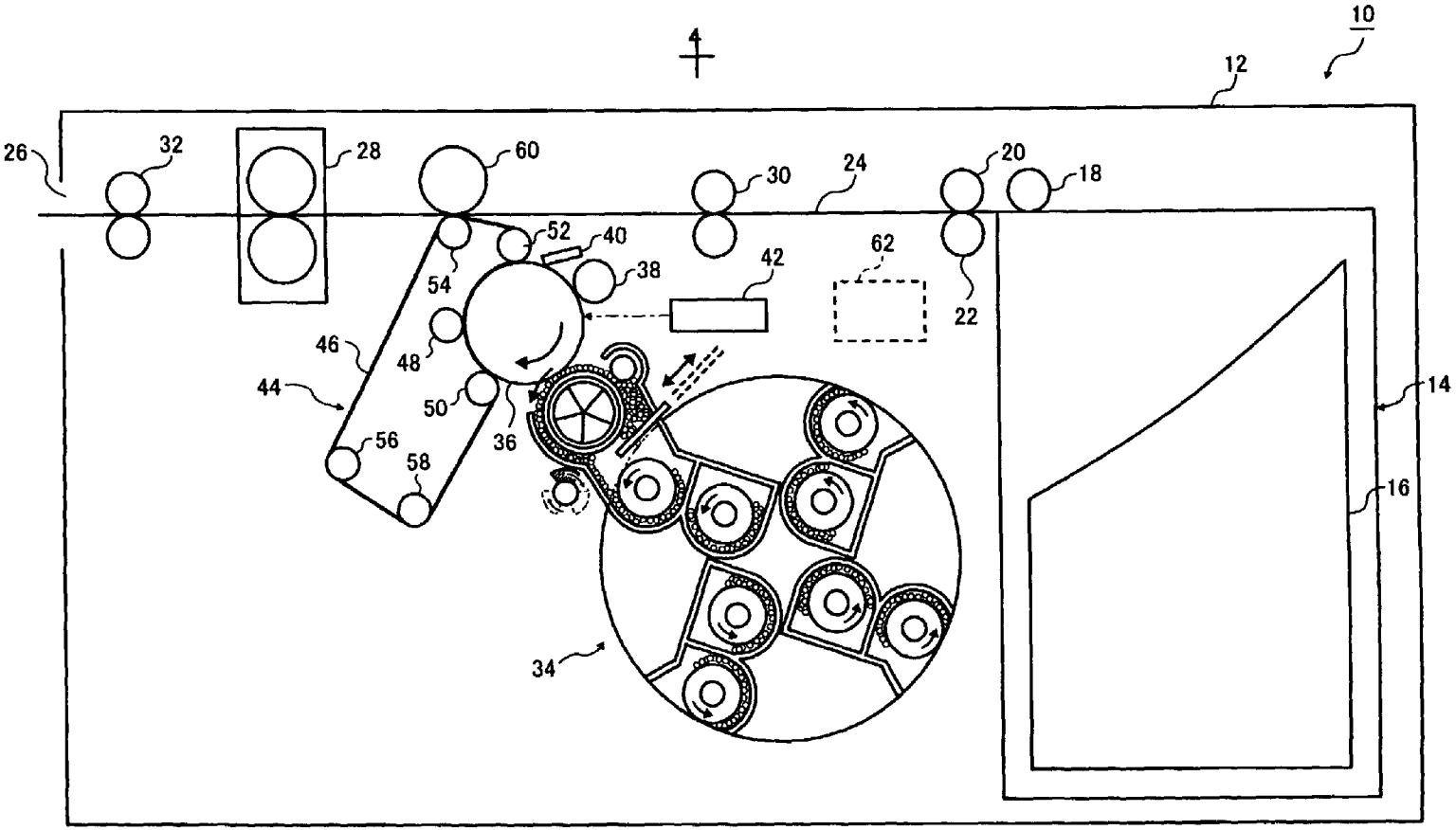
FIG. 1 is a cross-sectional view schematically showing the structure of an image forming apparatus according to a first exemplary embodiment of the present invention.

FIG. 1 schematically shows the structure of an image forming apparatus 10 according to the first exemplary embodiment of the present invention. The image forming apparatus 10 has an image forming apparatus main body 12. A paper feed unit 14 which is e.g. a single-stage unit is provided in the rear side (right side in FIG. 1) of the image forming apparatus main body 12.

The paper feed unit 14 has a paper feed cassette 16 in which print sheets are contained. A pickup roller 18 to pick up a print sheet from the paper cassette 16 is provided above the paper feed cassette 16, and a feed roller 20 and a retard roller 22 are provided ahead of the pickup roller 18.

The feed roller 20 is driven by a drive unit (not shown), and is rotated to feed a print sheet toward a conveyance passage 24 to be described later. The retard roller 22 is in press-contact with the feed roller 20 and is rotatable in correspondence with the rotation of the feed roller 20. The retard roller 22 is rotated along with the feed roller 20 to feed the print sheets one by one toward the conveyance passage 24 to be described later.

The conveyance passage 24 is a print sheet passage from the feed roller 20 to a discharge outlet 26. The conveyance passage 24, provided in an upper part of the image forming apparatus main body 12, is formed approximately horizontally from the paper feed unit 14 to the discharge outlet 26. In the conveyance passage 24, a second transfer roller 60 and a second transfer backup roller 54 to be described later are provided on the upstream side of a fixing device 28, and a registration roller 30 is provided on the upstream side of the second transfer roller 60 and the second transfer backup roller 54. Further, in the conveyance passage 24, a discharge roller 32 is provided in the vicinity of the discharge outlet 26.

Accordingly, the print sheets picked up with the pickup roller 18 from the paper feed cassette 16 of the paper feed unit 14 are retarded with the feed roller 20 and the retard roller 22, and only the top sheet is guided onto the conveyance passage 24. Then the print sheet is temporarily stopped with the registration roller 30, and at predetermined timing, a developer image is transferred onto the sheet while the sheet is passed between the second transfer roller 60 and the second transfer backup roller 54 to be described later. The transferred developer image is fixed to the print sheet by the fixing device 28. The print sheet is discharged with the discharge roller 32 from the discharge outlet 26.

The image forming apparatus main body 12 is provided with a developing device 34 in e.g. its approximate central portion. The developing device 34 visualizes an electrostatic latent image held on an image holder 36 to be described later with yellow, magenta, cyan and black color developers.

The image holder 36 having e.g. a photoreceptor is provided so as to be in press-contact with the developing device 34 from a front upper position in the image forming apparatus 10. A charging device 38 having e.g. a charging roller to uniformly charge the image holder 36 is provided on the rear side of the image holder 36. That is, a developing bias is applied to the image holder 36. Further, an image holder cleaner 40 is provided in contact with the image holder 36 on the upstream side of the charging device 38 in a rotational direction of the image holder 36. The image holder cleaner 40 scrapes off developer remaining on the image holder 36 after e.g. first transfer.

An exposure device 42 to write a latent image using light such as laser beam on the image holder 36 charged by the charging device 38 is provided above the developing device 34. Further, an intermediate transfer device 44 on which a developer image visualized by the developing device 34 is first-transferred in a first transfer position and which conveys the developer image to a second transfer position to be described later, is provided on the front side of the image holder 36.

The intermediate transfer device 44 has an intermediate transfer body 46 such as an intermediate transfer belt, a first transfer roller 48, support rollers 50 and 52, the second transfer backup roller 54 opposite to the second transfer roller 60 in the second transfer position to support the intermediate transfer body 46, and tension rollers 56 and 58. The intermediate transfer body 46 has a first transfer portion in wrap-contact with the image holder 36 between the support roller 50 provided upstream of the first transfer roller 48 and the support roller 52 provided downstream of the first transfer roller 48. The intermediate transfer body 46 winds around the image holder 36 only in a predetermined range, and rotates in accordance with the rotation of the image holder 36. The tension rollers 56 and 58 provide a predetermined tension force to the intermediate transfer body 46. Developer images on the image holder 36, i.e., yellow, magenta, cyan and black developer images, in e.g. this order, are first-transferred while they are overlaid onto the intermediate transfer body 46 with the first transfer roller 48. The intermediate transfer body 46 conveys the first-transferred developer image toward the second transfer roller 60 to be described later.

In the intermediate transfer device 44, the second transfer roller 60 is provided to be opposite to the second transfer backup roller 54 with the conveyance passage 24 therebetween. That is, the second transfer position is set between the second transfer roller 60 and the second transfer backup roller 54. The second transfer roller 60 second-transfers the developer image first-transferred on the intermediate transfer body 46 onto a print sheet in the second transfer position by assistance of the second transfer backup roller 54. Note that the second transfer roller 60 is away from the intermediate transfer body 46 while the intermediate transfer body 46 rotates three times, i.e., while the yellow, magenta and cyan developer images are conveyed. When the black developer image has been transferred, the second transfer roller 60 becomes in contact with the intermediate transfer body 46. Note that a predetermined potential difference is caused between the second transfer roller 60 and the second transfer backup roller 54. For example, when a high voltage is applied to the second transfer roller 60, the second transfer backup roller 54 is connected to the ground (GND) or the like.

The fixing device 28 is provided downstream of the second transfer position in the conveyance passage 24. The fixing device 28 has a heating roller and a pressure roller. The fixing device 28 fixes the developer image, second-transferred on the print sheet with the second transfer roller 60 and the second transfer backup roller 54, to the print sheet, and conveys the sheet toward the discharger roller 32.

Further, a controller (including a movement controller) 62 to control the respective constituent elements of the image forming apparatus 10 is provided in the image forming apparatus 10.

Next, the developing device 34 will be described in detail.

Figure 2:
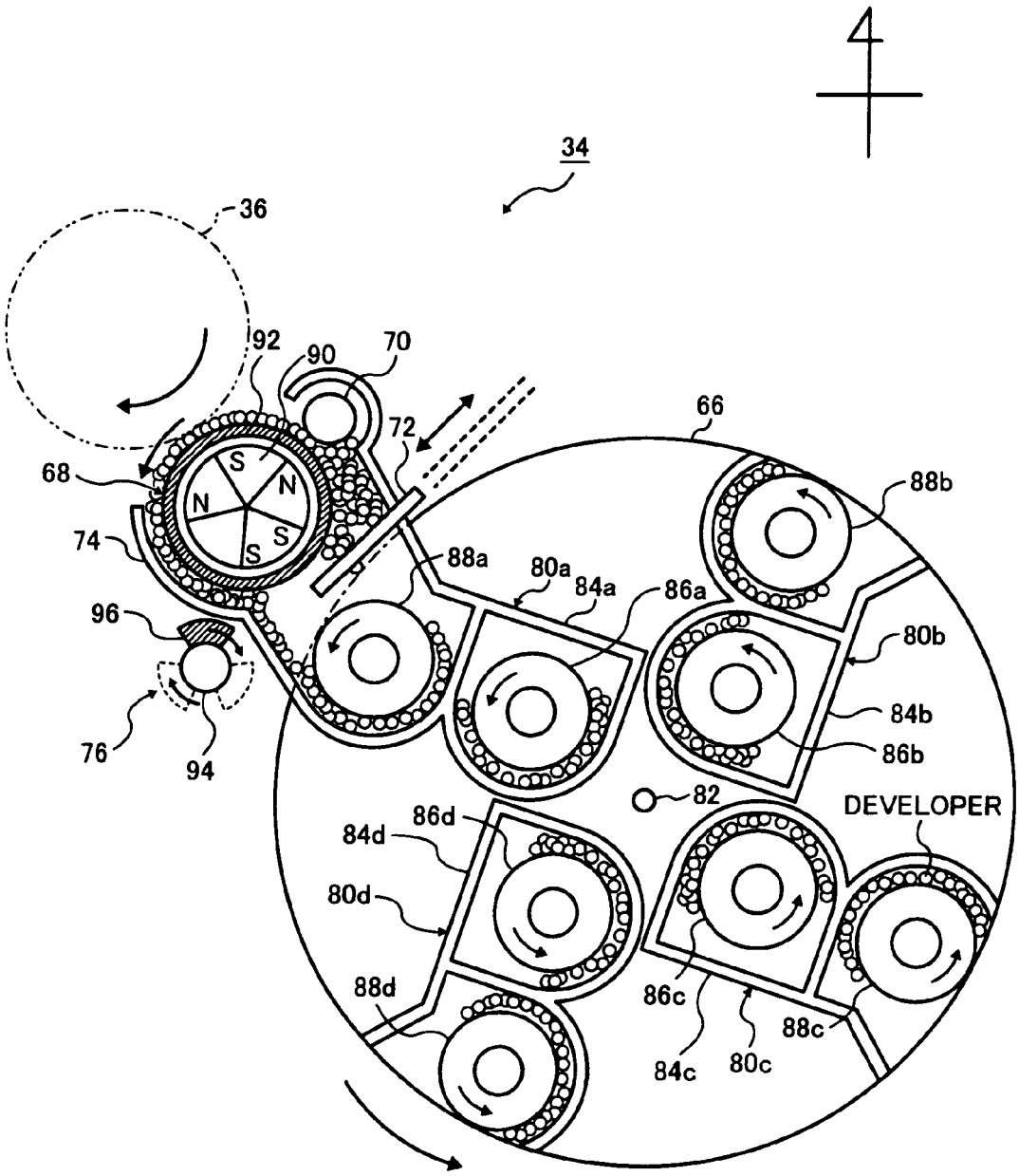
FIG. 2 is a cross-sectional view showing a first example of a developing device.

FIG. 2 shows a first example of the developing device 34. The developing device 34 has a developing device main body 66, a developing roller 68, a layer thickness regulating member 70, a blocking member 72, a developing roller accommodation wall 74 and a peeling member 76.

The developing device main body (rotating body) 66 is provided with detachable developer containers 80*a* to 80*d* respectively containing yellow, magenta, cyan and black developers. The developing device main body 66 is rotatably provided e.g. counterclockwise (counterclockwise in FIG. 2) about a rotation shaft 82, such that the developer containers 80*a* to 80*d* are sequentially moved to a position opposite to the developing roller 68. The developer containers 80*a* to 80*d* have container main bodies 84*a* to 84*d*, first augers 86*a* to 86*d* and second augers 88*a* to 88*d*. Developer cartridges (not shown) containing the above-described four color developers are attached to the container main bodies 84*a* and 84*d*. Further, the developer containers 80*a* to 80*d* contain developer supplied to the developing roller 68, and contain developer peeled off (collected) from the developing roller 68 after development.

Note that the developer contained in the developer containers 80*a* to 80*d* is two component developer including e.g. non-magnetic toner and magnetic carrier. The developer is stirred with the first stir-conveyance member 86 and the second stir-conveyance member 88, thereby the non-magnetic toner is attached around the magnetic carrier.

Hereinbelow, when any one of plural constituent elements such as developer containers 80*a* to 80*d* is described without particularly specifying it, it may be simply referred to as e.g. "developer container 80".

The first stir-conveyance member 86 conveys developer supplied from the developer cartridge (not shown) to the second stir-conveyance member 88. The second stir-conveyance member 88 stirs the developer, and when an opening of the container main body 84 is moved to a position opposite to the developing roller 68 by rotation of the developing device main body 66, the second stir-conveyance member 88 supplies the developer to the developing roller 68.

The developing roller 68 has a fixed magnet member 90 extending in its axial direction, with plural magnetic poles to attract developer (e.g., N poles) and magnetic poles to repel the developer (e.g., two continuous S poles) on its outer surface, and a cylindrical member 92 such as a sleeve, including the magnet member 90, which rotates and conveys developer in its circumferential direction in correspondence with a magnetic force of the magnet member 90. In the magnet member 90, the N poles to attract the developer from the developer container 80 are provided in e.g. upper positions on the developer container 80 side, and the S poles to repel the developer are provided in e.g. lower positions on the image holder 36 side and on the developer container 80 side (peel-off position). Further, the developing roller 68 is accommodated in a developing roller accommodation wall 74 opened such that a portion opposite to the image holder 36 is exposed. The developing roller 68 visualizes an electrostatic latent image on the image holder 36 with respective color developers held with the magnetic force while forming a predetermined gap between the roller and the image holder 36.

The layer thickness regulating member 70 regulates the layer thickness of developer attached to the surface of the developing roller 68 (held on the developing roller 68). The blocking member 72 moves in correspondence with control by the controller 62, and blocks supply of the developer from the developer container 80 to the developing roller 68. Note that the supply of the developer from the developer container 80 to the developing roller 68 can also be blocked by stopping the rotation of the second stir-conveyance member 88.

The peeling member 76 has a rotation shaft 94 provided approximately parallel to the developing roller 68 and a magnet 96 of e.g. rare earth which rotates clockwise (clockwise in FIG. 2) about the rotation shaft 94 under the control of the controller 62. The peeling member 76 peels off the developer held on the developing roller 68 with its magnetic force (by e.g. attraction with the N poles) and guides the developer to the developer container 80.

In the developing device, for various purposes, it is necessary to peel off developer on the developing roller 68 as much as possible. For example, when developer is changed, it is necessary to remove as much of the developer on the developing roller 68 and in the developer container 80 as possible. Further, in a case where development is performed on a single developing roller 68 using plural color toners, it is necessary to remove current color developer from the developing roller 68 and then supply the next color developer to the developing roller 68.

In FIG. 2, when the peeling member provided in the example of the present invention is not provided, the developing roller having magnetic poles inside peels off developer by using the above-described magnetic poles to repel the developer (peeling poles: e.g., two continuous S poles in FIG. 2). In this case, when the amount of the developer on the developing roller is reduced, as the flow of the developer for peeling is suppressed, developer remaining on the peeling poles occurs.

Figure 3A:
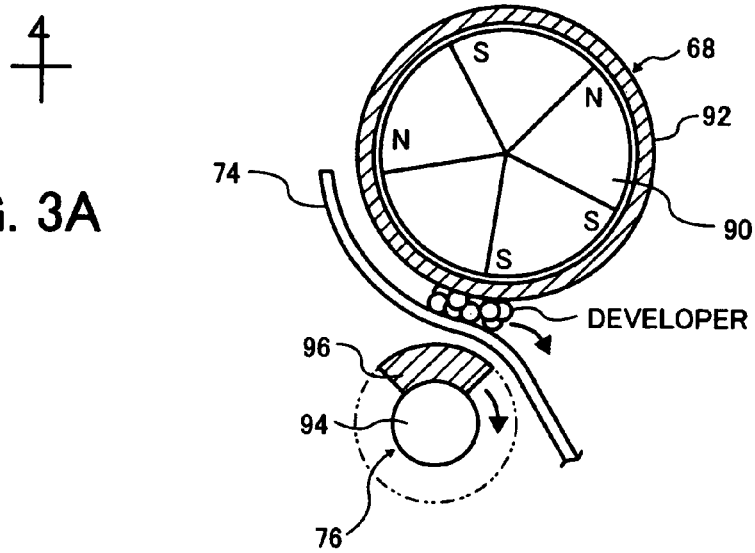
FIGS. 3A to 3C are expanded views showing a state where developer held on a developing roller is peeled off with a magnet.
Figure 3B:
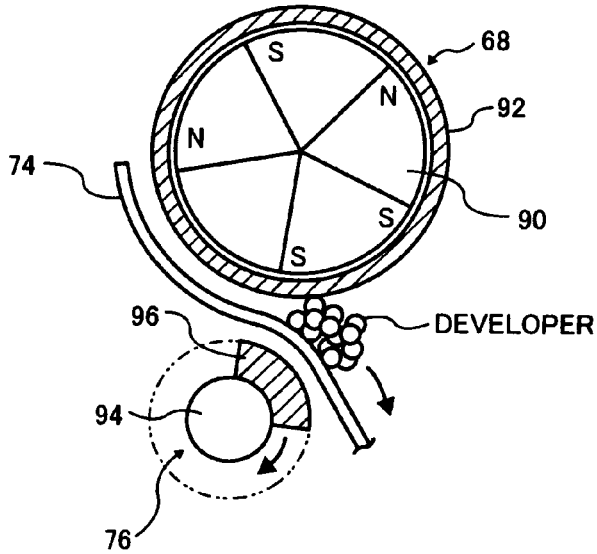
Figure 3C:
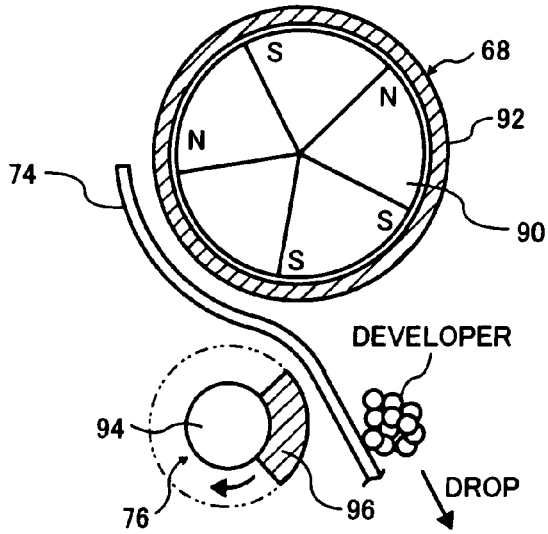

FIGS. 3A to 3C are expanded view showing a state where developer (including developer around the peel-off position) remaining on the developing roller 68 is peeled off by the magnet 96. As shown in FIG. 3A, when the peeling member 76 provided below the developing roller 68 via the developing roller accommodation wall 74 rotates and the magnet 96 approaches the developing roller 68, the magnet 96 attracts the developer to the lower side of the developing roller accommodation wall 74. Further, as shown in FIG. 3B, when the peeling member 76 rotates and the magnet 96 begins to move away from the developing roller 68, the developer is peeled off from the developing roller 68 with the magnetic force of the magnet 96. Further, as shown in FIG. 3C, when the peeling member 76 further rotates and the magnet 96 further moves away from the developing roller 68, the developer is moved downward along the developing roller accommodation wall 74 while the developer is attracted with the magnetic force of the magnet 96, and further, drops downward in a region not influenced by the above-described magnetic force.

Note that the developing roller accommodation wall 74 is a partition wall partitioning the peeling member 76 from the developer. The developing roller accommodation wall 74 is formed to have an area in which distances to the developing roller 68 and the magnet 96 are increased as the magnet 96 moves away from the position close to the developing roller 68.

In this manner, when the peeling member 76 peels off developer, the magnet 96 approaches the developing roller 68 side such that the magnetic force of the magnet 96 acts on the developer held on the developing roller 68. When the peeling member 76 has peeled off the developer, the magnet 96 rotate-moves (clockwise in FIG. 3B) away from the developing roller 68 such that the peeled developer is isolated from the developing roller 68.

Note that when the developing roller 68 visualizes an electrostatic latent image, the controller 62 stops the magnet 96 in a position where the action of the magnetic force of the magnet 96 on the developer held on the developing roller 68 is lowered (on the side opposite to the developing roller 68). Then, when the blocking member 72 has blocked supply of developer, the controller 62 rotate-moves the magnet 96 such that the magnetic force of the magnet 96 acts on the developer held on the developing roller 68.

Next, the operation of the first exemplary embodiment of the present invention will be described.

When an image forming signal is sent, the image holder 36 is uniformly charged by the charging device 38, and light is emitted from the exposure device 42 based on the image signal to the charged image holder 36. The light from the exposure device 42 exposes the surface of the image holder 36, and an electrostatic latent image is formed.

The electrostatic latent image held on the image holder 36 is developed by the developing device 34 by developer color, and first-transferred onto the intermediate transfer body 46. Then the respective color developer images are overlaid on the intermediate transfer body 46, and a color image is formed.

The yellow, magenta, cyan and black developers are supplied from the developer containers 80*a* to 80*d* to the developing roller 68. Then, developer excessively supplied to the developer 68 is collected into the same color developer container 80 before supply of the next color developer to the developing roller 68. Upon first transfer, waste developer remaining on the image holder 36 is scraped off with the image holder cleaner 40, and is collected.

On the other hand, in accordance with a paper feed signal or the like, print sheets contained in the paper feed cassette 16 are picked up with the pickup roller 18, retarded with the feed roller 20 and the retard roller 22, and only the top print sheet is guided to the conveyance passage 24. The print sheet is temporarily stopped with the registration roller 30, and at predetermined timing, guided between the second transfer roller 60 and the second transfer backup roller 54. When the print sheet has been guided between the second transfer roller 60 and the second transfer backup roller 54, the developer image first-transferred on the intermediate transfer body 46 is second-transferred onto the print sheet with the second transfer roller 60 and the second transfer backup roller 54.

The print sheet on which the developer image has been transferred is guided to the fixing device 28, and the developer image is fixed to the print sheet with the heating roller and the pressure roller. The print sheet on which the developer image has been fixed is discharged with the discharge roller 32 from the discharge outlet 26.

Note that the image forming apparatus 10 may form only a monochrome image. For example, the developing device 34 may be arranged to have a developer container 80, the developing roller 68, the layer thickness regulating member 70, the blocking member 72, the developing roller accommodation wall 74 and the peeling member 76. In this case, the developing device 34 acts as a developing unit to visualize an electrostatic latent image with one developer.

Next, a modification of the magnet 96 will be described.

Figure 4:
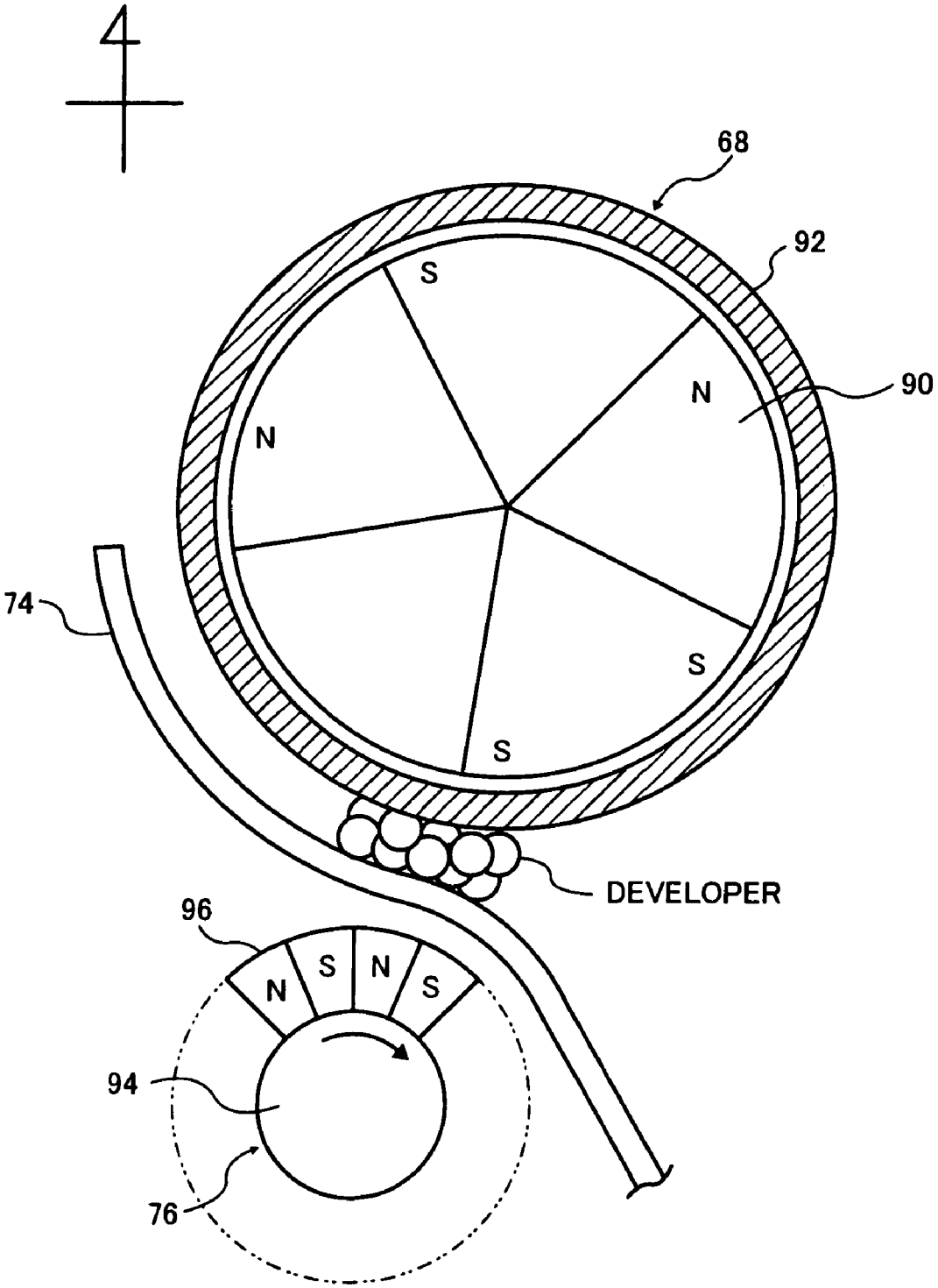
FIG. 4 is an expanded view showing a modification of the magnet in FIG. 2 and its peripheral portion.

FIG. 4 is an expanded view showing a modification of the magnet 96 and its peripheral portion. As shown in FIG. 4, the magnet 96 may have two pairs of a magnetic pole (S pole) to repel developer with a magnetic field formed between the magnetic pole and the S pole of the developing roller 68 and a magnetic pole (N pole) to attract the developer, arrayed sequentially from e.g. the downstream side in its moving direction. In this manner, in a case where the magnet 96 has two pairs of a magnetic pole to repel developer and a magnetic pole to attract the developer from the downstream side in the moving direction, when the peeling member 76 rotates clockwise (clockwise in FIG. 4) in correspondence with control by the controller 62, the magnet 96 repels developer positioned between the peeling member 76 and the developing roller 68 to the developer container 80 side, then attracts developer held on the developing roller 68 and remaining on the upstream side of the rotational direction of the peeling member 76 thereby peel off the developer from the developing roller 68, and guides the developer to the developer container 80 side. The magnet 96 performs this operation twice.

Next, a second example of the developing device will be described.

Figure 5A:
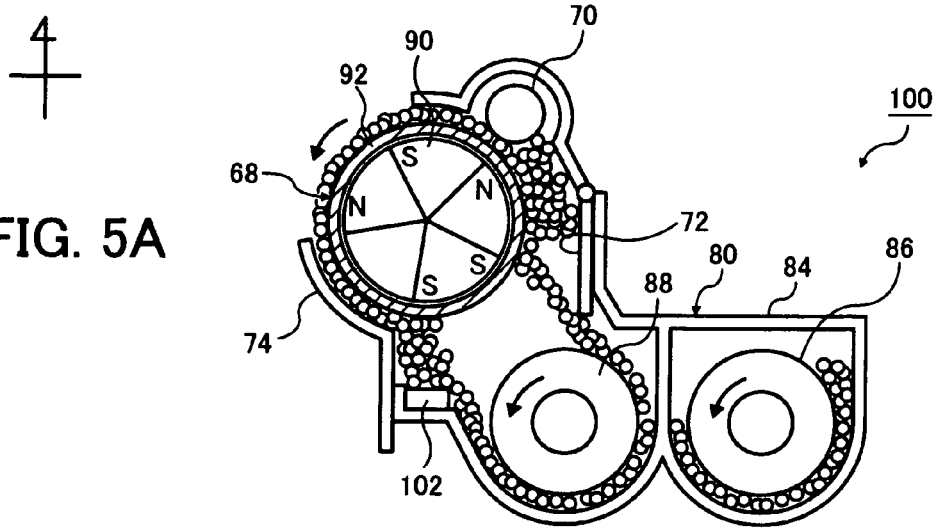
FIGS. 5A to 5C are cross-sectional views showing the structure of a second example of the developing device.
Figure 5B:
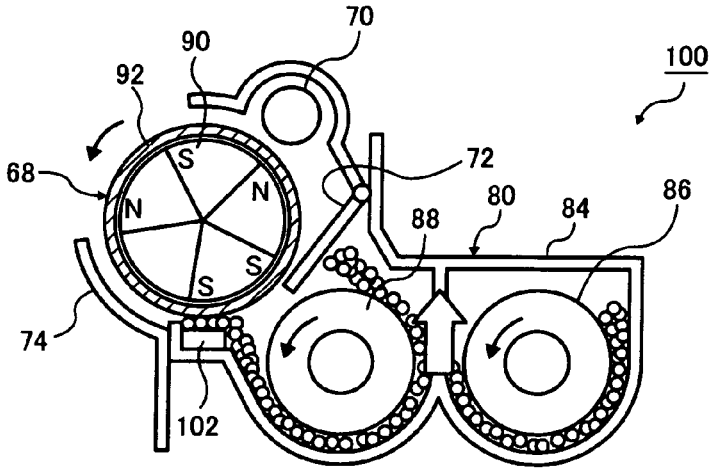
Figure 5C:
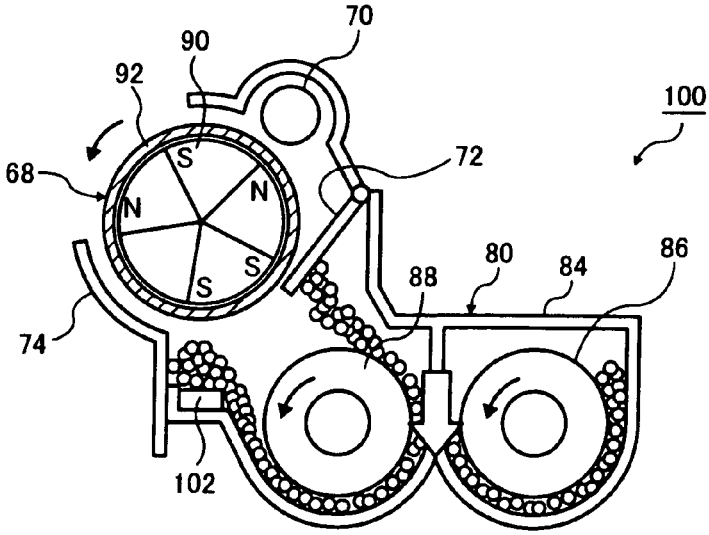

FIGS. 5A to 5C are cross-sectional views showing the structure of the second example of the developing device (developing device 100). Note that it may be arranged such that in the developing device 100 shown in FIGS. 5A to 5C, having four developer containers, supplies developer from one developer container to the developing roller, and visualizes an electrostatic latent image with one color developer.

Further, in the developing device 100, constituent elements substantially the same as those of the developing device 34 shown in FIG. 2 have the same reference numerals.

The developing device 100 has the developer container 80, the developing roller 68, the layer thickness regulating member 70, the blocking member 72, the developing roller accommodation wall 74 and a magnet 102. The magnet 102, fixed in the developer container 80 below the developing roller 68, attracts developer with its magnetic force. In the developing device 100, the developer container 80 is moved with respect to the developing roller accommodation wall 74 under the control of the controller 62 such that the magnet 102 moves close to or away from the developing roller 68.

Note that the magnet 102 may form, with another member, the peeling member to peel off developer from the developing roller 68.

As shown in FIG. 5A, in the developing device 100, when developer is supplied from the developer container 80 to the developing roller 68, the developer container 80 is positioned in a lower position (lower side in FIG. 5A) such that the magnet 102 is away from the developing roller 68. Further, as shown in FIG. 5B, in the developing device 100, when the magnet 102 starts peeling of the developer from the developing roller 68, the developer container 80 is moved upward (upper side in FIG. 5B) such that the magnet 102 approaches the developing roller 68 after blocking the supply of the developer from the developer container 80 to the developing roller 68 by the blocking member 72. Then, as shown in FIG. 5C, in the developing device 100, the developer container 80 is moved downward in a state where the blocking member 72 blocks the supply of the developer from the developer container 80 to the developing roller 68, thereby the magnet 102 peels off the developer held on the developing roller 68.

Note that the developing device 100 may be arranged such that, when, e.g., developer is supplied to the developing roller from one of four developer containers of the rotating developing device, some of the developer attracted by the magnet 102 is peeled off from the magnet 102 by a centrifugal force by rotation of the developing device, free fall or the like.

Further, the developing device 100 may be arranged such that the second stir-conveyance member 88 is a magnetized member thereby the developer attracted by the magnet 102 is peeled off from the magnet 102.

Next, a third example of the developing device will be described.

Figure 6A:
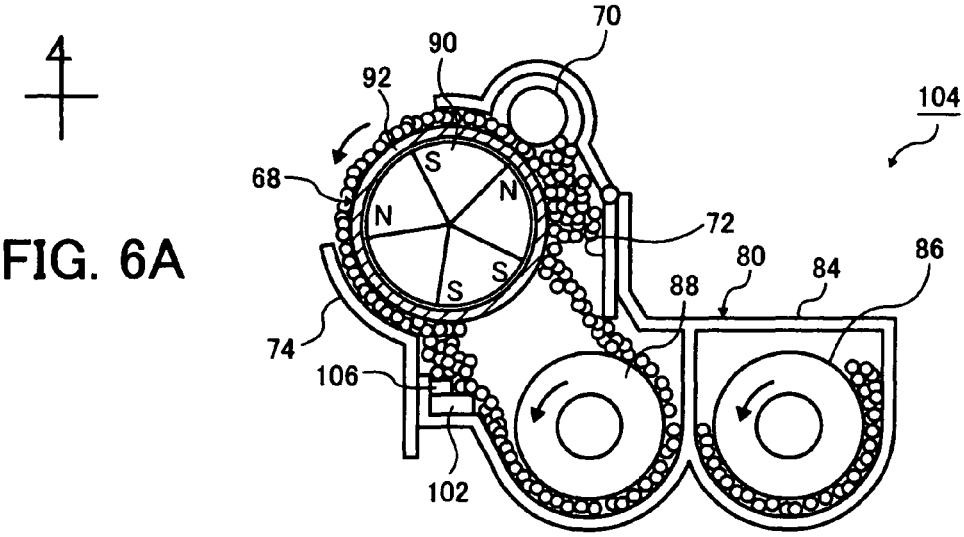
FIGS. 6A to 6C are cross-sectional views showing the structure of a third example of the developing device.
Figure 6B:
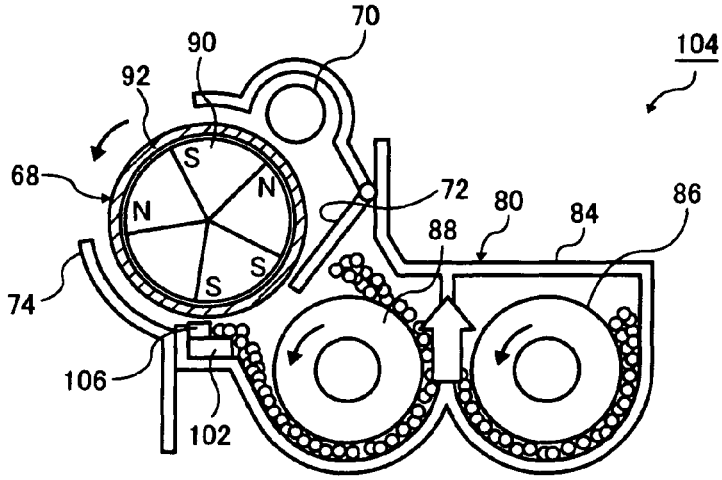
Figure 6C:
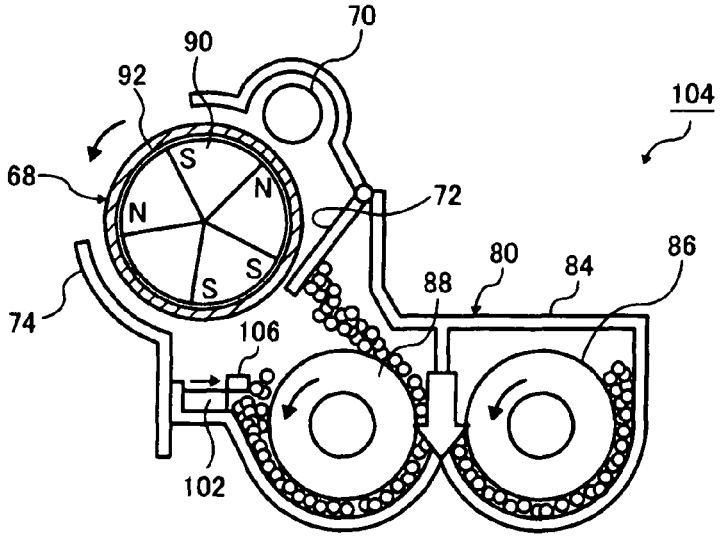

FIGS. 6A to 6C are cross-sectional views showing the structure of the third example of the developing device (developing device 104). Note that the developing device 104 shown in FIGS. 6A to 6C may be arranged such that developer is supplied from one of four developer container to the developing roller and an electrostatic latent image is visualized with one color developer.

Further, in the developing device 104, constituent elements substantially the same as those of the developing device 100 shown in FIGS. 5A to 5C have the same reference numerals.

The developing device 104 has the developer container 80, the developing roller 68, the layer thickness regulating member 70, the blocking member 72, the developing roller accommodation wall 74, the magnet 102 and a repeeling member 106. The repeeling member 106 is movable upward/downward together with the magnet 102 and is movable leftward/rightward along an upper surface of the magnet 102. The repeeling member 106 scrapes off developer attracted to the upper surface of the magnet 102.

As shown in FIG. 6A, in the developing device 104, when developer is supplied from the developer container 80 to the developing roller 68, the developer container 80 is positioned in a lower position (lower side in FIG. 6A) such that the magnet 102 is away from the developing roller 68 together with the repeeling member 106. Further, as shown in FIG. 6B, in the developing device 104, when the magnet 102 starts peeling of the developer from the developing roller 68, the developer container 80 is moved upward (upper side in FIG. 6B) such that the magnet 102 approaches the developing roller 68 together with the repeeling member 106 after blocking the supply of the developer from the developer container 80 to the developing roller 68 by the blocking member 72. Then, as shown in FIG. 6C, in the developing device 104, the developer container 80 is moved downward in a state where the blocking member 72 blocks the supply of the developer from the developer container 80 to the developing roller 68, thereby the magnet 102 peels off the developer held on the developing roller 68 and the repeeling member 106 scrapes off the developer attracted to the magnet 102, and the developer is collected in the developer container 80.

Next, a fourth example of the developing device will be described.

Figure 7:
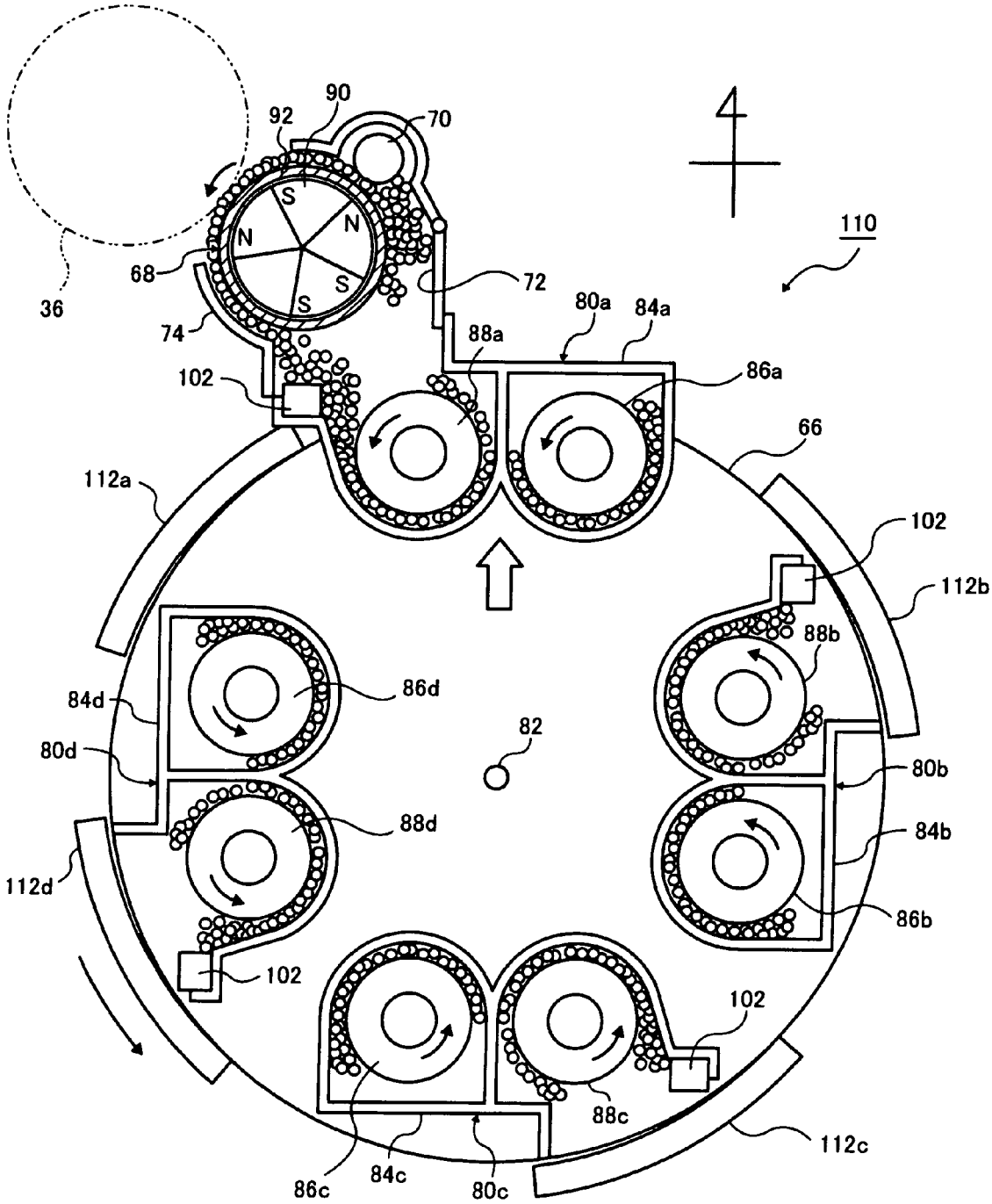
FIG. 7 is a cross-sectional view showing a state where developer is supplied from a developer container to the developing roller in a fourth example of the developing device.
Figure 8:
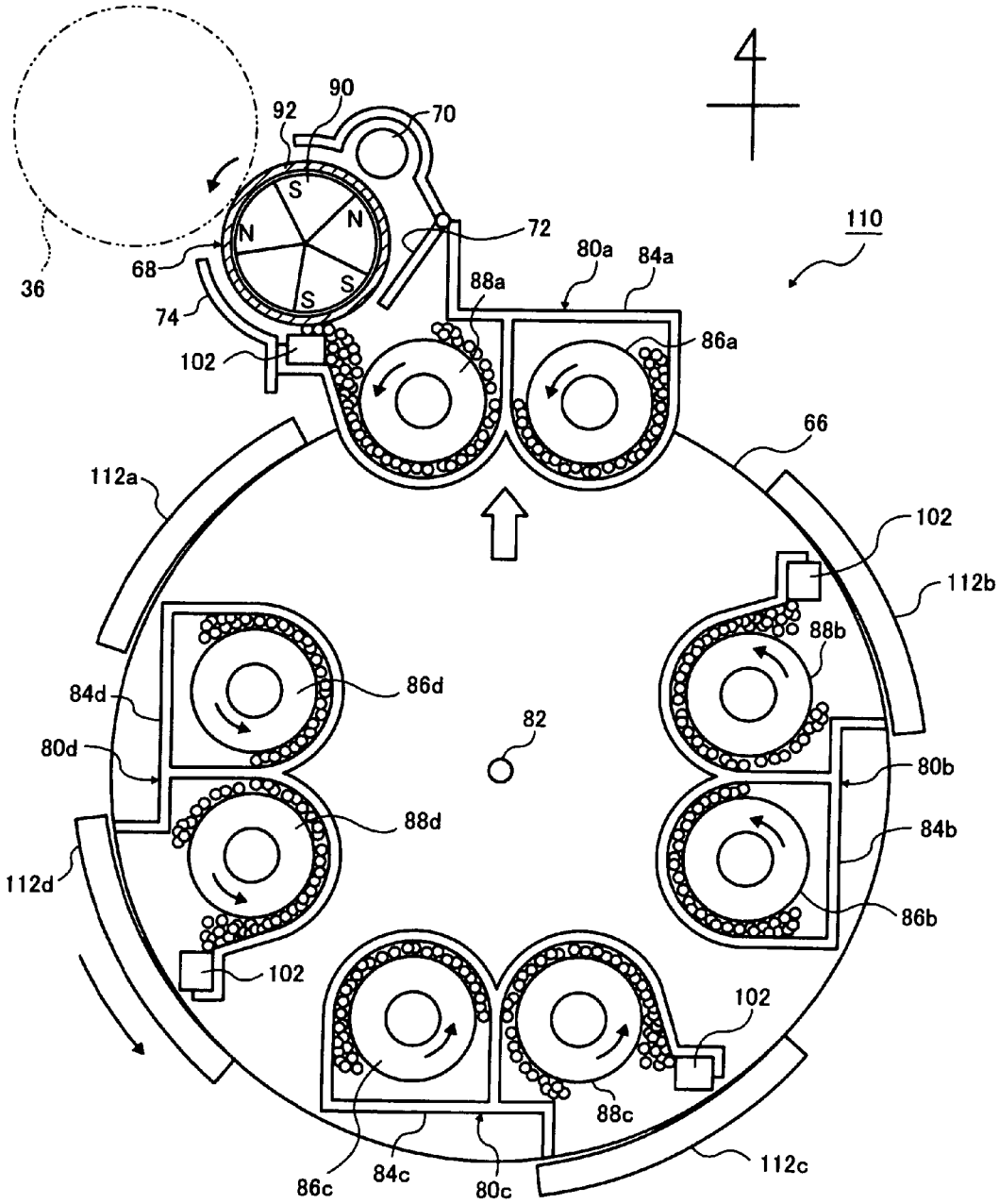
FIG. 8 is a cross-sectional view showing a state where the peeling member starts peeling of the developer from the developing roller in the fourth example of the developing device.
Figure 9:
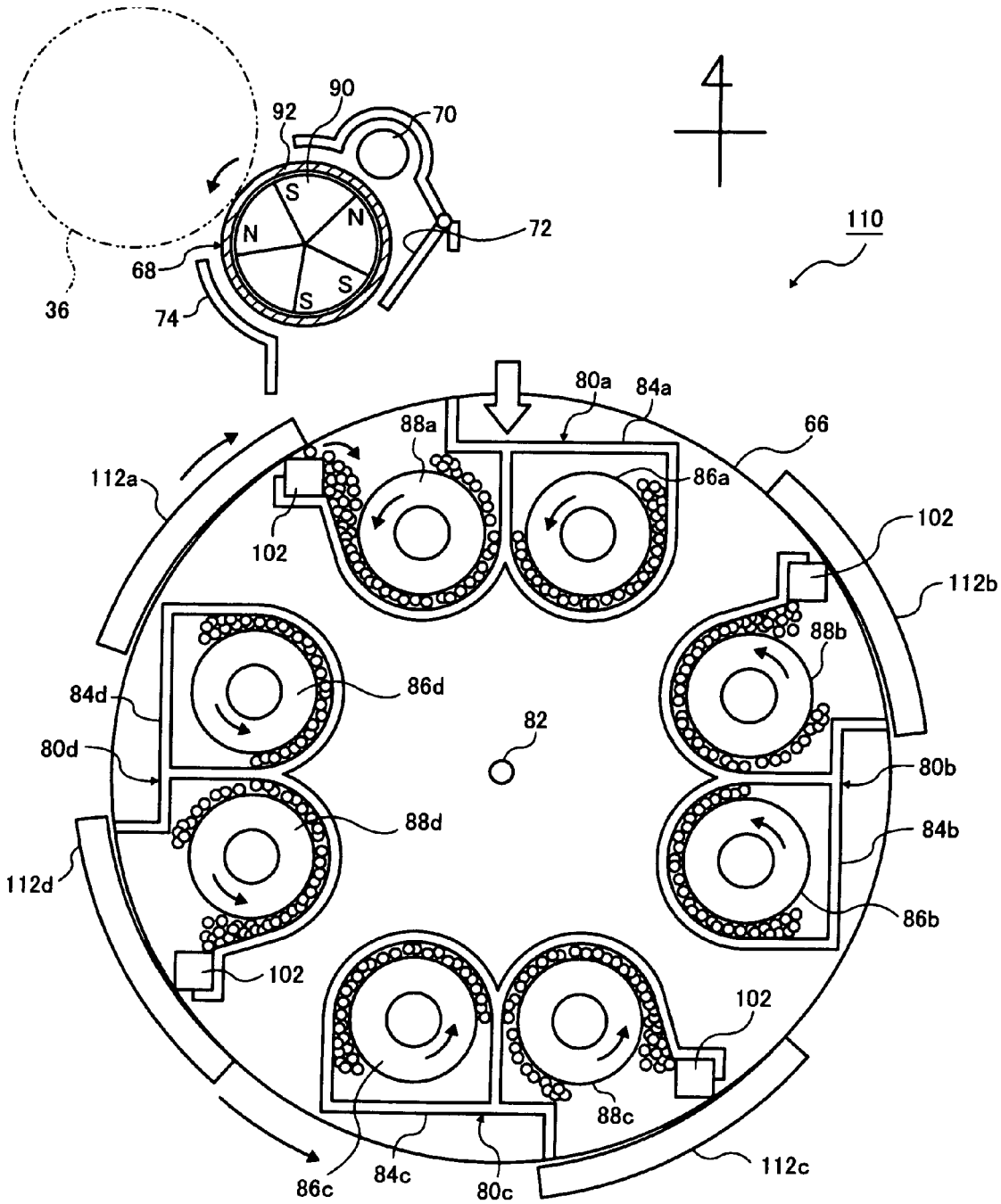
FIG. 9 is a cross-sectional view showing a state where the developer container has moved into a developing device main body in a lower position in the fourth example of the developing device.

FIGS. 7 to 9 show the fourth example of the developing device (developing device 110). Note that in the developing device 110 shown in FIGS. 7 to 9, constituent elements substantially the same as those of the developing device 34 shown in FIG. 2 and the developing device 100 shown in FIGS. 5A to 5C have the same reference numerals.

The developing device 110 has the developing device main body 66, the developing roller 68, the layer thickness regulating member 70, the blocking member 72 and the developing roller accommodation wall 74. The developer containers 80*a* to 80*d* provided in the developing device main body 66 are respectively provided with the magnet 102. Further, the developing device main body 66 is provided opening/closing members 112*a* to 112*d* to close the openings of the developer containers 80*a* to 80*d* opened in the position opposite to the developing roller 68 when the developer containers 80*a* to 80*d* move to another position. The opening/closing member 112 closes the opening of the developer container 80 when the developer container 80 moves from the position opposite to the developing roller 68, and scrapes off developer attracted to the upper surface of the magnet 102 and collects the developer in the developer container 80.

Note that the opening/closing members 112*a* to 112*d* may be respectively provided in the developer containers 80*a* to 80*d*.

As shown in FIG. 7, in the developing device 110, when developer is supplied from the developer container 80 to the developing roller 68, the opening/closing member 112 is opened and the developer container 80 is moved upward from the developing device main body 66 such that the developing roller 68 approaches the image holder 36 in a state where the magnet 102 is away from the developing roller 68. Further, as shown in FIG. 8, in the developing device 110, when the magnet 102 starts peeling of the developer from the developing roller 68, the developer container 80 is moved upward (upper side in FIG. 8) such that the magnet 102 further approaches the developing roller 68 after blocking the supply of the developer from the developer container 80 to the developing roller 68 by the blocking member 72. Then, as shown in FIG. 9, in the developing device 110, the developer container 80 is moved in the developing device main body 66 in a lower position in a state where the blocking member 72 blocks the supply of the developer from the developer container 80 to the developing roller 68, thereby the magnet 102 peels off the developer held on the developing roller 68 and the opening/closing member 112 scrapes off the developer attracted to the magnet 102, and collects the developer in the developer container 80.

Next, a fifth example of the developing device will be described.

Figure 10A:
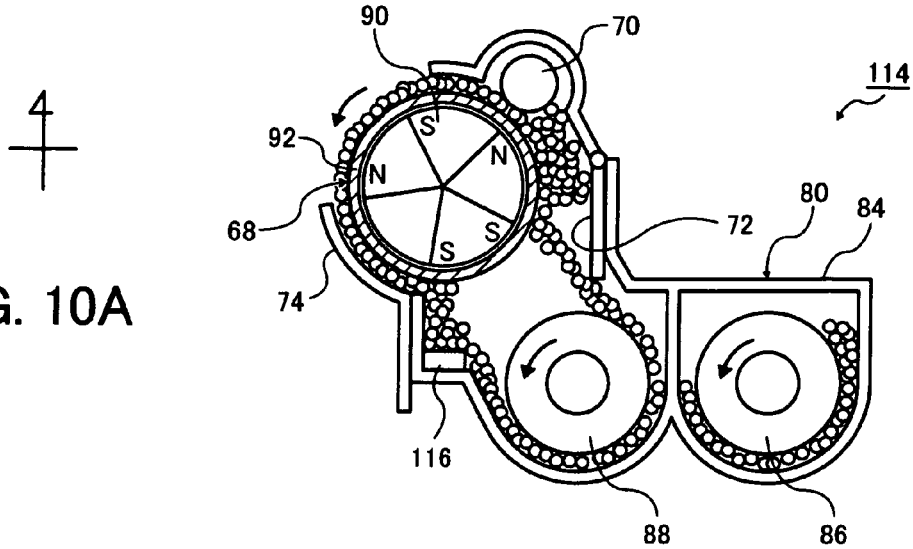
FIGS. 10A to 10C are cross-sectional views showing the structure of a fifth example of the developing device.
Figure 10B:
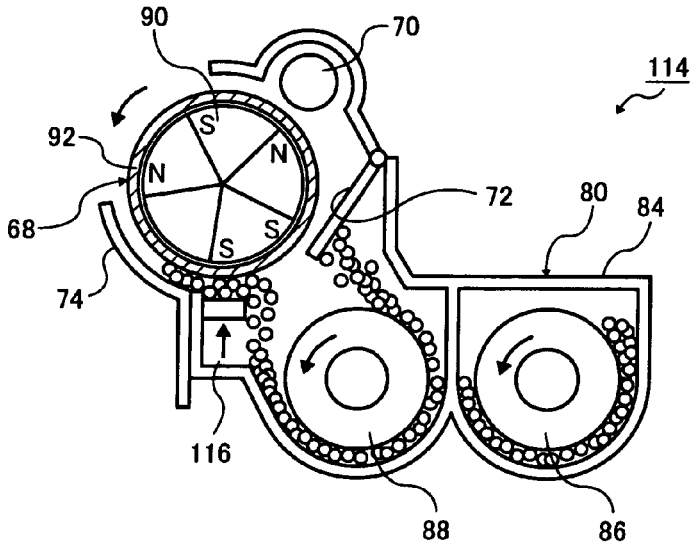
Figure 10C:
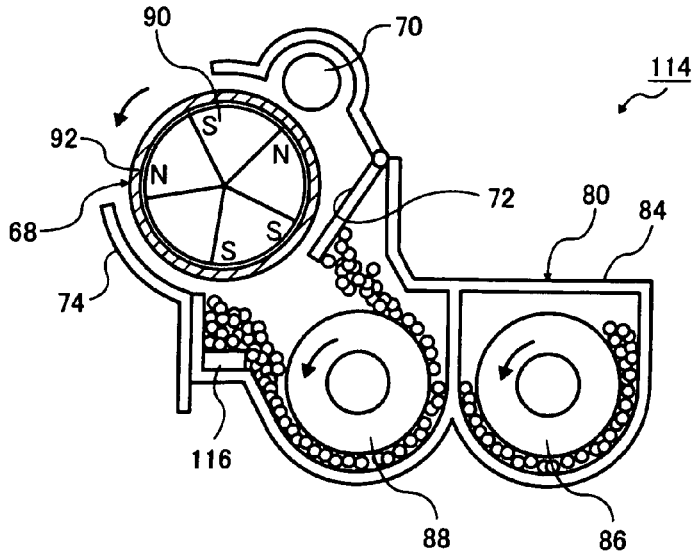

FIGS. 10A to 10C are cross-sectional views showing the structure of the fifth example of the developing device (developing device 114). Note that the developing device 114 shown in FIGS. 10A to 10C may be arranged such that developer is supplied from one of four developer containers to the developing roller and an electrostatic latent image is visualized with single-color developer.

Further, in the developing device 114, constituent elements substantially the same as those of the developing device 100 shown in FIGS. 5A to 5C have the same reference numerals.

The developing device 114 has the developer container 80, the developing roller 68, the layer thickness regulating member 70, the blocking member 72, the developing roller accommodation wall 74 and a magnet 116. The magnet 116 is movable close to or away from the developing roller 68 within the developer container 80 under the control of the controller 62. The magnet 116 attracts developer with its magnetic force. In the developing device 114, the developer container 80 is fixed with respect to the developing roller accommodation wall 74.

Note that the magnet 116 may form, with another member, the peeling member to peel off developer from the developing roller 68.

As shown in FIG. 10A, in the developing device 114, when developer is supplied from the developer container 80 to the developing roller 68, the magnet 116 is positioned in a lower position in the developer container 80 (lower side in FIG. 10A) such that the magnet 116 is away from the developing roller 68. Further, as shown in FIG. 10B, in the developing device 114, when the magnet 116 starts peeling of the developer from the developing roller 68, the magnet 116 is moved upward in the developer container 80 (upper side in FIG. 10B) such that the magnet 116 approaches the developing roller 68 after blocking the supply of the developer from the developer container 80 to the developing roller 68 by the blocking member 72. Then, as shown in FIG. 10C, in the developing device 114, the magnet 116 is moved downward in a state where the blocking member 72 blocks the supply of the developer from the developer container 80 to the developing roller 68, thereby the magnet 116 peels off the developer held on the developing roller 68.

Next, a sixth example of the developing device will be described.

Figure 11A:
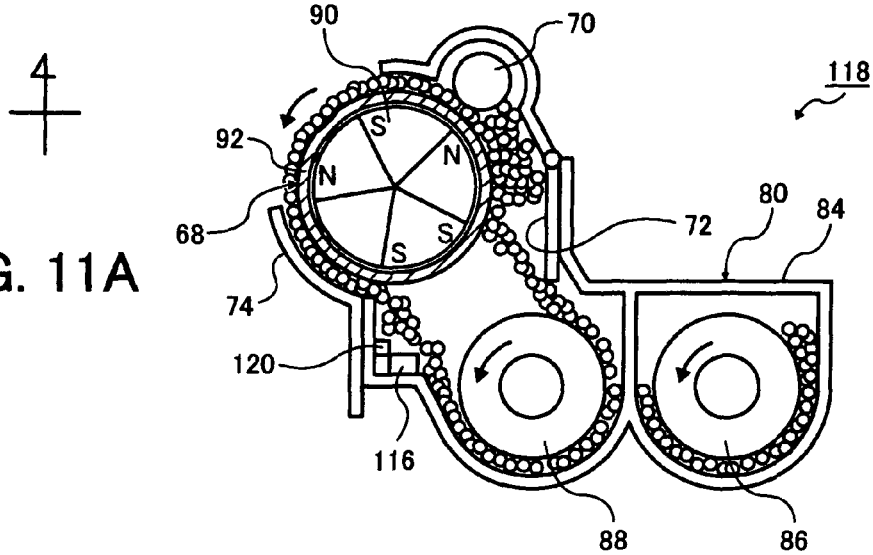
FIGS. 11A to 11C are cross-sectional views showing the structure of a sixth example of the developing device.
Figure 11B:
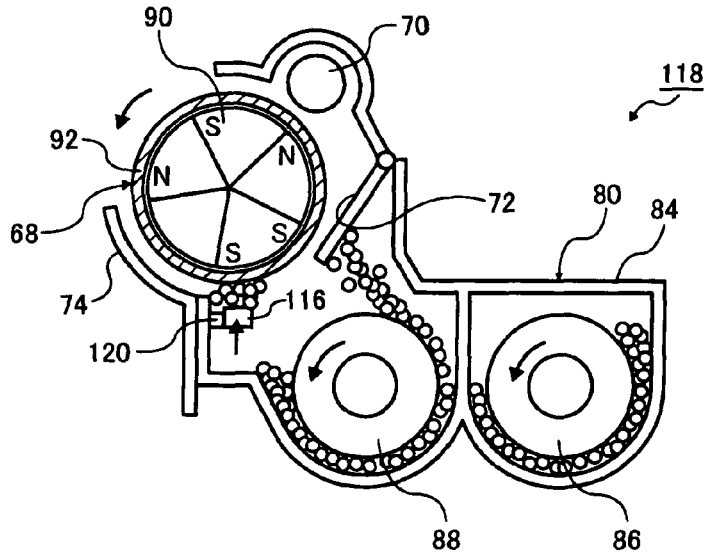
Figure 11C:
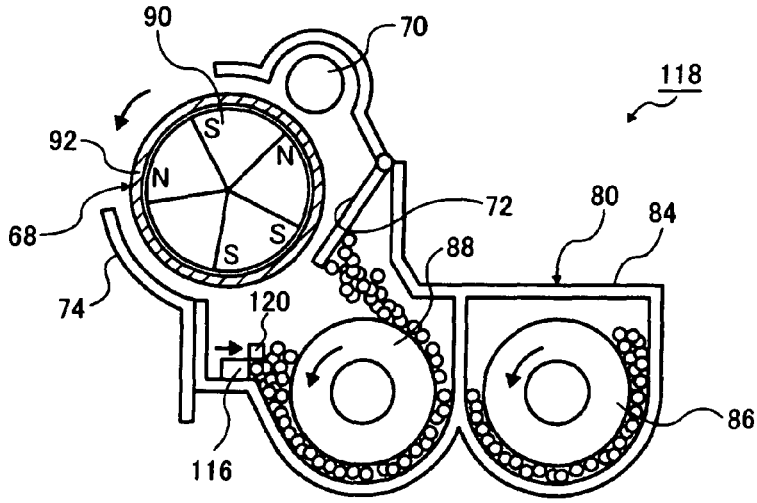

FIGS. 11A to 11C are cross-sectional views showing the structure of the sixth example of the developing device (developing device 118). Note that the developing device 118 shown in FIGS. 11A to 11C may be arranged such that developer is supplied from one of four developer containers to the developing roller and an electrostatic latent image is visualized with one color developer.

Further, in the developing device 118, constituent elements substantially the same as those of the developing device 114 shown in FIGS. 10A to 10C have the same reference numerals.

The developing device 118 has the developer container 80, the developing roller 68, the layer thickness regulating member 70, the blocking member 72, the developing roller accommodation wall 74, the magnet 116 and a repeeling member 120. The repeeling member 120 is movable upward/downward together with the magnet 116 and is movable leftward/rightward along an upper surface of the magnet 116. The repeeling member 120 scrapes off developer attracted to the upper surface of the magnet 116.

As shown in FIG. 11A, in the developing device 118, when developer is supplied from the developer container 80 to the developing roller 68, the magnet 116 is positioned in a lower position in the developer container 80 (lower side in FIG. 11A) such that the magnet 116 is away from the developing roller 68 together with the repeeling member 120. Further, as shown in FIG. 11B, in the developing device 118, when the magnet 116 starts peeling of the developer from the developing roller 68, the magnet 116 is moved upward in the developer container 80 (upper side in FIG. 11B) such that the magnet 116 approaches the developing roller 68 together with the repeeling member 120 after blocking the supply of the developer from the developer container 80 to the developing roller 68 by the blocking member 72. Then, as shown in FIG. 11C, in the developing device 118, the magnet 116 is moved downward in a state where the blocking member 72 blocks the supply of the developer from the developer container 80 to the developing roller 68, thereby the magnet 116 peels off the developer held on the developing roller 68, and the repeeling member 120 scrapes off the developer attracted to the magnet 116, and collects the developer in the developer container 80.

Next, a seventh example of the developing device will be described.

Figure 12A:
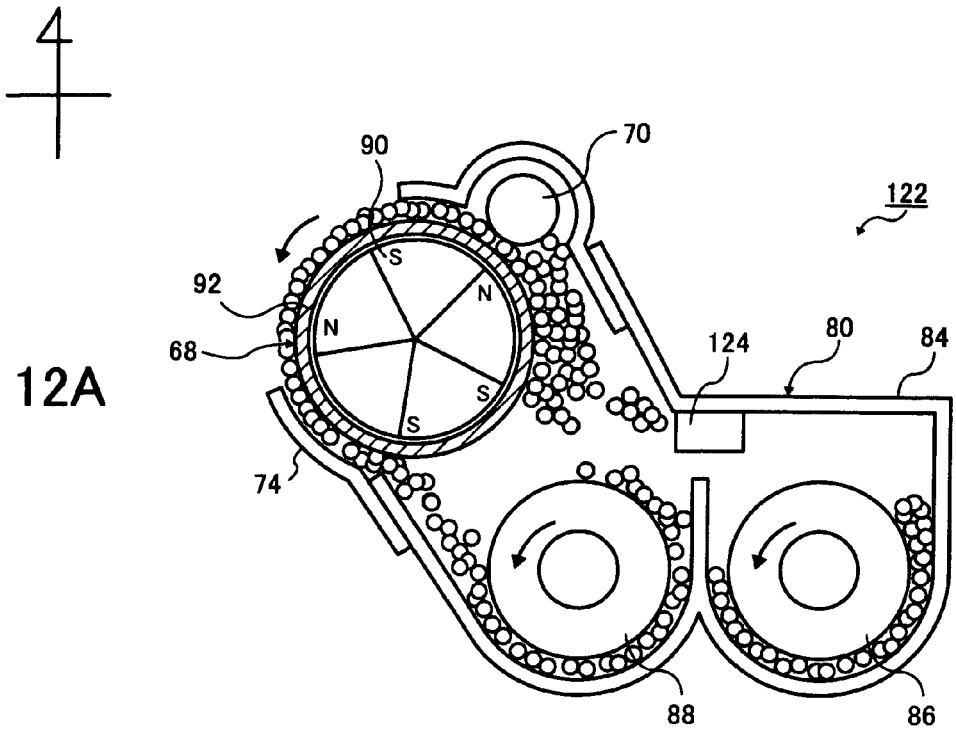
FIGS. 12A and 12B are cross-sectional views showing the structure of a seventh example of the developing device.
Figure 12B:
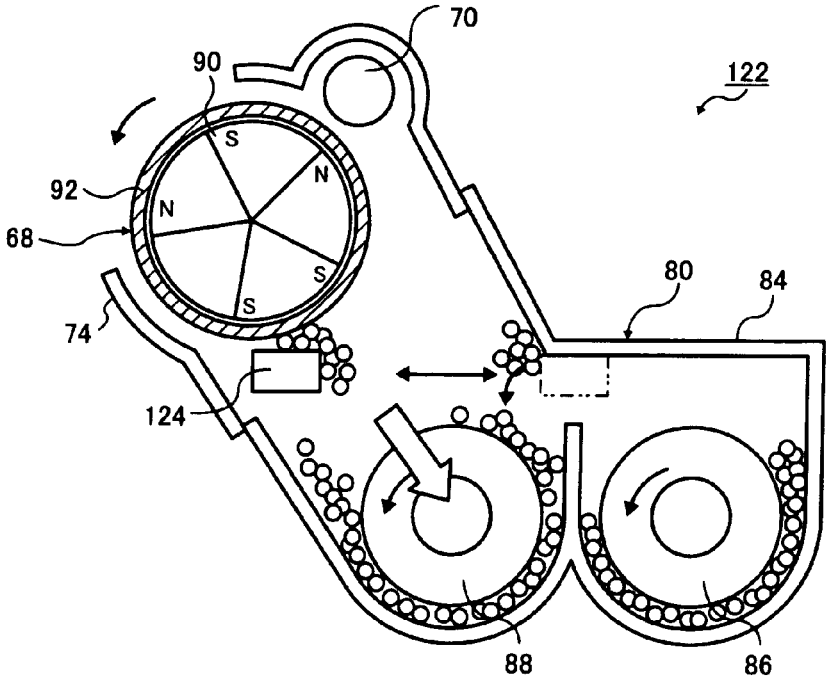

FIGS. 12A and 12B are cross-sectional views showing the structure of the seventh example of the developing device (developing device 122). Note that the developing device 122 shown in FIGS. 12A and 12B is applied to a developing unit to visualize an electrostatic latent image with e.g. one color developer.

Further, in the developing device 122, constituent elements substantially the same as those of the developing device 114 shown in FIGS. 10A to 10C have the same reference numerals.

The developing device 122 has the developer container 80, the developing roller 68, the layer thickness regulating member 70, the developing roller accommodation wall 74 and a magnet 124. The magnet 124 attracts developer held on the developing roller 68 with its magnetic force, and slides in contact with an inner upper portion of the container main body 84 thereby repeels off the attracted developer. Further, in the developing device 122, the developer container 80 is movable in a direction where the second stir-conveyance member 88 approaches or moves away from the developing roller 68.

Note that the magnet 124 may form, with another member, the peeling member to peel off developer from the developing roller 68.

As shown in FIG. 12A, in the developing device 122, when developer is supplied from the developer container 80 to the developing roller 68, the magnet 124 is positioned below an inner upper portion of the container main body 84. Further, the developer container 80 is stopped in a state where the second stir-conveyance member 88 is close to the developing roller 68.

Further, as shown in FIG. 12B, in the developing device 122, when the magnet 124 peels off the developer from the developing roller 68, the magnet 124 approaches the developing roller 68 and attracts the developer held on the developing roller 68, thereafter, slides in contact with the inner upper portion of the container main body 84 after the attraction of the developer, thereby repeels off the attracted developer. That is, the developer attracted by the magnet 124 is collected in the developer container 80. Note that the developer container 80 is stopped in a state where the second stir-conveyance member 88 has moved away from the developing roller 68.

Next, a second exemplary embodiment of the present invention will be described based on the drawings.

Figure 13:
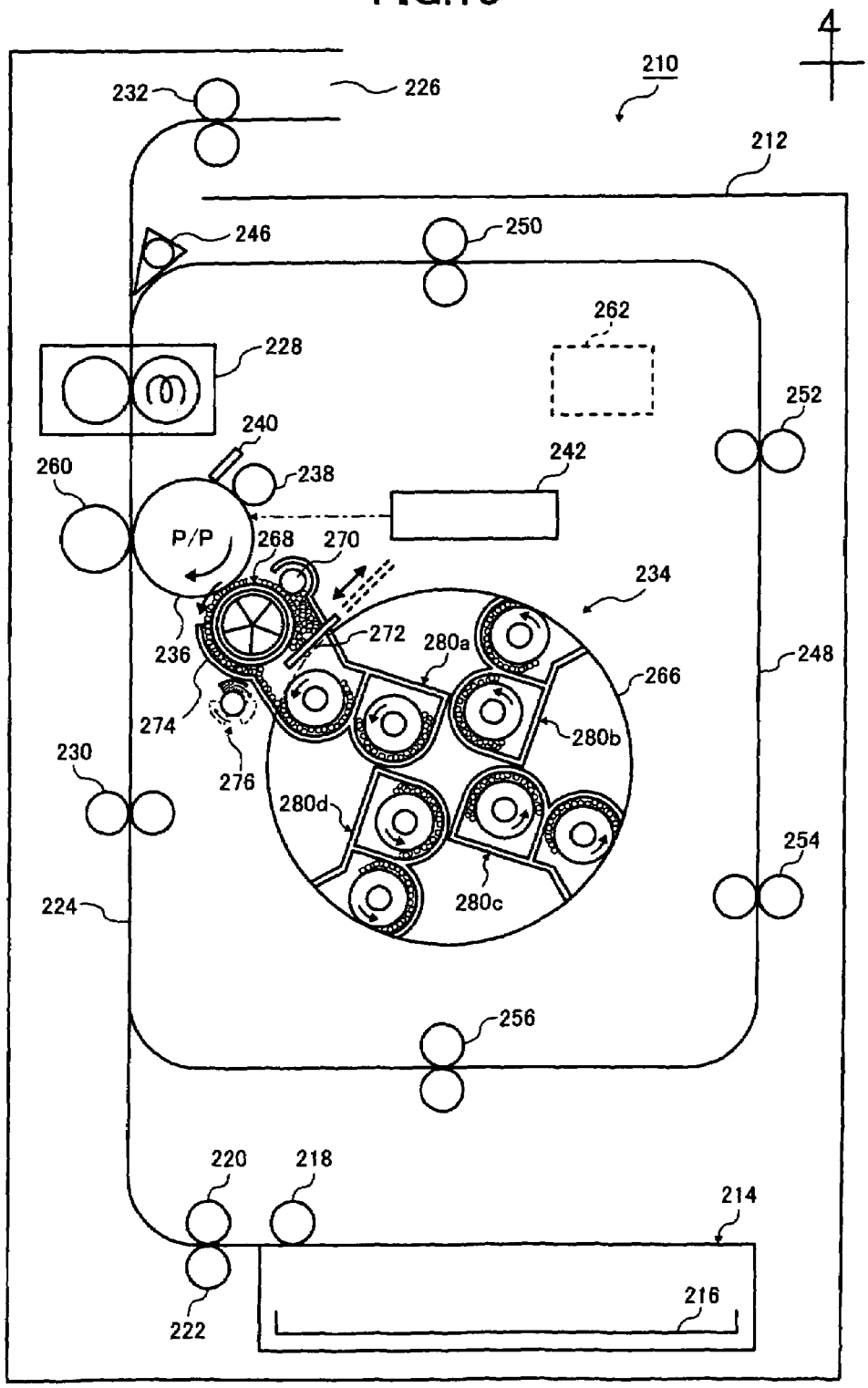
FIG. 13 is a cross-sectional view schematically showing the structure of the image forming apparatus according to a second exemplary embodiment of the present invention.

FIG. 13 is a cross-sectional view schematically showing the structure of an image forming apparatus 210 according to the second exemplary embodiment of the present invention. The image forming apparatus 210 has an image forming apparatus main body 212. A paper feed unit 214 which is e.g. a single-stage unit is provided in a lower part of the image forming apparatus main body 212.

The paper feed unit 214 has a paper feed cassette 216 in which print sheets are contained. A pickup roller 218 to pick up a print sheet from the paper cassette 216 is provided above the paper feed cassette 216, and a feed roller 220 and a retard roller 222 are provided ahead of the pickup roller 218.

The feed roller 220 is driven by a drive unit (not shown), and is rotated to feed a print sheet toward a conveyance passage 224 to be described later. The retard roller 222 is in press-contact with the feed roller 220 and is rotatable in correspondence with the rotation of the feed roller 220. The retard roller 222 is rotated in correspondence with rotation of the feed roller 220 to feed the print sheets one by one toward the conveyance passage 224 to be described later.

The conveyance passage 224 is a print sheet passage from the feed roller 220 to a discharge outlet 226. The conveyance passage 224, provided on the rear side of the image forming apparatus main body 212 (left side in FIG. 13), has an approximately vertical portion extending from the paper feed unit 214 to the discharge outlet 226. In the conveyance passage 224, an image holder 236 and a transfer roller 260 to be described later are provided on the upstream side of a fixing device 228, and a registration roller 230 is provided on the upstream side of the image holder 236 and the transfer roller 260. Further, in the conveyance passage 224, a discharge roller 232 is provided in the vicinity of the discharge outlet 226.

Accordingly, the print sheets picked up with the pickup roller 218 from the paper feed cassette 216 of the paper feed unit 214 are retarded with the feed roller 220 and the retard roller 222, and only the top sheet is guided onto the conveyance passage 224. Then the print sheet is temporarily stopped with the registration roller 230, and at predetermined timing, a developer image in e.g. black is transferred onto the sheet while the sheet is passed between the image holder 236 and the transfer roller 260 to be described later. The transferred black developer image is fixed to the print sheet by the fixing device 228. The print sheet is discharged with the discharge roller 232 from the discharge outlet 226.

In the case of color printing, the print sheet is returned to a repeat passage three times. That is, in the conveyance passage 224, a part ahead of the discharge roller 232 is branched into two passages, and a switch device 246 is provided in the branch portion and a repeat passage 248 to return from the branch portion to the registration roller 230 is formed. Conveyance rollers 250, 252, 254 and 256 are provided on the repeat passage 248. In the case of color printing, the switch device 246 is switched to the side to open the repeat passage 248, then the print sheet is guided to the repeat passage 248, then passed through the registration roller 230, between the image holder 236 and the transfer roller 260 and through the fixing device 228 four times, and is discharged from the discharge outlet 226.

The image forming apparatus main body 212 is provided with a developing device 234 in e.g. its approximate central portion. The developing device 234 visualizes an electrostatic latent image held on the image holder 236 to be described later with yellow, magenta, cyan and black color developers. Note that the developing device 234, having a developing device main body 266, a developing roller 268, a layer thickness regulating member 270, a blocking member 272, a developing roller accommodation wall 274, a peeling member 276 and developer containers 280*a* to 280*d* and the like, has substantially the same configuration as that of the developing device 34 shown in FIG. 2.

The image holder 236 having e.g. a photoreceptor is in contact with the developing device 234 from an upper position on the rear side of the image forming apparatus 210. A charging device 238 having e.g. a charging roller to uniformly charge the image holder 236 is provided on the front side of the image holder 236. That is, a developing bias is applied to the image holder 236. Further, an image holder cleaner 240 is provided in contact with the image holder 236 on the upstream side of the charging device 238 in a rotational direction of the image holder 236. The image holder cleaner 240 removes developer remaining on the image holder 236 after transfer.

An exposure device 242 to write an electrostatic latent image using light such as laser beam on the image holder 236 charged by the charger 238 is provided above the developing device 234. Further, the transfer roller 260 to transfer a developer image visualized by the developing device 234 onto a print sheet in a transfer position is provided on the rear side of the image holder 236.

The fixing device 228 is provided downstream of the transfer position in the conveyance passage 224. The fixing device 228 has a heating roller and a pressure roller. The fixing device 228 fixes the developer image, transferred on the print sheet with the image holder 236 and the transfer roller 260, to the print sheet, and conveys the sheet.

Further, a controller (including a movement controller) 262 to control the respective constituent elements of the image forming apparatus 210 is provided in the image forming apparatus 210.

Next, the operation (color printing) of the second exemplary embodiment of the present invention will be described.

When an image forming signal is sent, the image holder 236 is uniformly charged by the charger 238, and light corresponding to an yellow image is emitted from the exposure device 242 based on the image signal to the charged image holder 236. The light from the exposure device 242 exposes the surface of the image holder 236, and an electrostatic latent image is formed.

The electrostatic latent image held on the image holder 236 is developed with yellow developer supplied to the developing roller 268 of the developing device 234, and transferred onto a print sheet fed from the paper feed unit 214. Then the print sheet on which the yellow developer image has been transferred is guided to the fixing device 228, and the developer image is fixed to the print sheet with the heating roller and the pressure roller. The print sheet on which the yellow developer image is fixed is returned by the switch device 246 to the repeat passage 248.

The developer held on the developing roller 268 (remaining on the developing roller 268) is peeled off by the peeling member 276 and is collected in the developer container 280*a*. Then, the developing device main body 266 of the developing device 234 rotates, thereby magenta developer is supplied to the developing roller 268. The image holder 236 is uniformly charged by the charger 238, and light corresponding to a magenta image is emitted from the exposure device 242 based on the image signal to the charged image holder 236. The light from the exposure device 242 exposes the surface of the image holder 236, and an electrostatic latent image is formed.

The electrostatic latent image held on the image holder 236 is developed with magenta developer supplied to the developing roller 268 of the developing device 234, and transferred onto the print sheet. Then the print sheet on which the magenta developer image has been transferred is guided to the fixing device 228, and the developer image is fixed to the print sheet with the heating roller and the pressure roller. The print sheet on which the magenta developer image is fixed is returned by the switch device 246 to the repeat passage 248.

As the print sheet is returned to the repeat passage 248 three times, as in the case of the yellow and magenta developer images, developer images developed with cyan and black developers are fixed to the print sheet by the fixing device 228, then a color image in which the developer images are overlaid is formed on the print sheet. The print sheet on which the color image is fixed is guided to the discharge roller 232 by the switch device 246 and is discharged.

Note that in the above exemplary embodiment, an electrostatic latent image is visualized using two component developer, however, the developer is not limited to this type of developer. For example, the developing device 34 may visualize an electrostatic latent image using single component developer.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A developing unit comprising:

a developer carrying member that visualizes an electrostatic latent image held on an image carrying member using magnetic developer;

a peeling member that peels off the magnetic developer passed through an area to visualize the electrostatic latent image and held on the developer carrying member by a magnetic force; and a movement controller that controls movement of the peeling member, when the peeling member peels off the magnetic developer to change the magnetic developer held on the developer carrying member from a first color to a second color, movement controller moving the peeling member to a position close to the developer carrying member, and when the peeling member has peeled off the magnetic developer, the movement controller moving the peeling member to a position away from the developer carrying member.

2. The developing unit according to claim 1, further comprising a partition wall that partitions the peeling member from the magnetic developer wherein the partition wall has a shape including a portion where a distance between the peeling member and the partition wall becomes longer along a direction in which the peeling member moves away from the position close to the developer carrying member.

3. The developing unit according to claim 2, wherein the partition wall, also as a developer carrying member container member that contains the developer carrying member, is opened so as to expose a portion of the developer carrying member opposite to the image carrying member.

4. The developing unit according to claim 1, wherein the developer carrying member has a fixed magnet member that extends in an axial direction with a magnetic pole to attract developer and a magnetic pole to repel the developer on an outer surface, and a cylindrical member containing the fixed magnet member inside that rotates and conveys the developer in a circumferential direction in correspondence with a magnetic force of the fixed magnet member, and the peeling member includes one or more combinations of the magnetic pole to repel the developer and the magnetic pole to attract the developer along a moving direction, and peels off the developer held on the developer carrying member by repelling and then attracting developer positioned between the peeling member and the developer carrying member in correspondence with control by the movement controller.

5. The developing unit according to claim 1, wherein the movement controller controls movement of the peeling member in a direction to rotate about a rotation shaft provided approximately parallel to the developer carrying member.

6. The developing unit according to claim 1, further comprising a developer container that contains developer supplied to the developer carrying member, and a blocking section that blocks supply of the developer from the developer container to the developer carrying member, wherein when the blocking section has blocked the supply of the developer, the movement controller controls the movement of the peeling member so as to act the magnetic force of the peeling member on the developer held on the developer carrying member.

7. The developing unit according to claim 1, further comprising a developer container with the peeling member fixed inside, that contains developer supplied to the developer carrying member and developer collected from the developer carrying member, and a blocking section that blocks supply of the developer from the developer container to the developer carrying member, wherein when the blocking section has blocked the supply of the developer, the movement controller moves the developer container to thereby control the movement of the peeling member.

8. The developing unit according to claim 7, wherein the peeling member further has a repeeling section, including a magnet that attracts the developer held on the developer carrying member with a magnetic force, that again peels off the developer attracted by the peeling member from the peeling member.

9. The developing unit according to claim 1, further comprising a plurality of developer containers that contain developer supplied to the developer carrying member, and a rotating body that rotates to move the plurality of developer containers to a position opposite to the developer carrying member.

10. The developing unit according to claim 9, further comprising a partition wall that partitions the peeling member from the magnetic developer, wherein the partition wall has a shape including a portion where a distance to the peeling member becomes longer along a direction in which the peeling member moves away from the position close to the developer carrying member.

11. The developing unit according to claim 9, wherein when the developer carrying member visualizes the electrostatic latent image, the movement controller controls the peeling member to withdraw into an area where the action of the magnetic force of the peeling member on the developer held on the developer carrying member is lowered.

12. The developing unit according to claim 9, wherein the developer carrying member has a fixed magnet member that extends in an axial direction with a magnetic pole to attract developer and a magnetic pole to repel the developer on an outer surface, and a cylindrical member containing the fixed magnet member inside that rotates and conveys the developer in a circumferential direction in correspondence with a magnetic force of the fixed magnet member, and the peeling member includes one or more combinations of the magnetic pole to repel the developer and the magnetic pole to attract the developer sequentially arrayed from a downstream side of a moving direction, and peels off the developer held on the developer carrying member by repelling and then attracting developer positioned between the peeling member and the developer carrying member in correspondence with control by the movement controller.

13. A developing device comprising:

a developer carrying member that visualizes an electrostatic latent image held on an image carrying member using magnetic developer;

a rotating body having a plurality of developer containers containing magnetic developer supplied to the developer carrying member, that rotates so as to move the plurality of developer containers to a position opposite to the developer holding member;

a plurality of peeling members, fixed inside the plurality of developer containers, that peel off the magnetic developer passed through an area to visualize the electrostatic latent image held on the image carrying member and held on the developer carrying member with a magnetic force; and a movement controller that controls movement of the peeling member, when the peeling member peels off the magnetic developer to change the magnetic developer held on the developer carrying member from a first color to a second color, the movement controller moving the peeling member to a position close to the developer holding member, and when the peeling member has peeled off the magnetic developer, the movement controller moving the peeling member to a position away from the developer holding member.

14. The developing device according claim 13, further comprising a blocking section that blocks supply of the developer from the plurality of developer containers to the developer carrying member, wherein when the blocking section has blocked the supply of the developer, the movement controller moves the developer containers so as to control the movement of the magnet.

15. The developing device according to claim 13, wherein the plurality of peeling members further have a repeeling section, including a magnet that attracts the developer held on the developer carrying member with a magnetic force, that again peels off the developer attracted by the peeling member from the peeling member.

16. The developing device according to claim 13, wherein the plurality of peeling members include a magnet that attracts the developer held on the developing member with a magnetic force, and the plurality of developer containers have an inner shape to again peel off the developer attracted by the peeling member from the magnet upon movement of the magnet.

17. The developing device according to claim 13, herein the plurality of developer containers respectively have an opening/closing member to open/close a portion opposite to the developer carrying member, and the opening/closing member again peels off the developer attracted by the magnet from the magnet.

18. An image forming apparatus comprising: an image carrying member;

a developer carrying member that visualizes an electrostatic latent image held on the image carrying member using developer held with a magnetic force;

a peeling member having a magnet that peels off the developer passed through an area to visualize the electrostatic latent image held on the image carrying member and held on the developer carrying member with a magnetic force; and a movement controller that, when the peeling member peels off the developer to change the developer held on the developer carrying member from a first color to a second color, controls movement of the magnet to move close to the developer carrying member so as to act the magnetic force of the magnet on the developer held on the developer carrying member, and when the peeling member has peeled off the developer, controls movement of the magnet to move away from the developer carrying member so as to move the peeled developer from the developer carrying member.

19. The image forming apparatus according to claim 18, further comprising a rotating body, having a plurality of developer containers containing developer supplied to the developer carrying member, that rotates so as to move the plurality of developer containers to a position opposite to the developer carrying member.

20. The image forming apparatus according to claim 18, herein the developer carrying member has a fixed magnet member that extends in an axial direction with a magnetic pole to attract developer and a magnetic pole to repel the developer on an outer surface, and a cylindrical member containing the fixed magnet member inside that rotates and conveys the developer in a circumferential direction in correspondence with a magnetic force of the fixed magnet member, and the peeling member includes one or more combinations of the magnetic pole to repel the developer and the magnetic pole to attract the developer along a moving direction, and peels off the developer held on the developer carrying member by repelling and then attracting developer positioned between the peeling member and the developer carrying member in correspondence with control by the movement controller.

* * * * *